US006444960B1

(12) United States Patent
Rodriguez et al.

(10) Patent No.: US 6,444,960 B1
(45) Date of Patent: Sep. 3, 2002

(54) HEADING ELEMENT FOR CHARGING DEVICES

(75) Inventors: Alberto Rodriguez; John Stephen Facci, both of Webster; Heiko Rommelmann, Penfield; Scott Weber, Canandaigua; Joseph David La Russa, Rochester; Jing Quing Song, Webster; Chris Snelling, Rochester; Kenneth W. Pietrowski, Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/045,173

(22) Filed: Jan. 11, 2002

(51) Int. Cl.[7] ..... H05B 3/26
(52) U.S. Cl. ..... 219/543; 219/552; 338/307
(58) Field of Search ..... 219/543, 521, 219/520, 522, 535, 538, 540, 552, 553; 422/122, 174; 338/307

(56) References Cited

U.S. PATENT DOCUMENTS 4,155,093 A 5/1979 Fotland et al. ..... 346/159
4,803,503 A * 2/1989 Mayer ..... 347/123
5,245,502 A 9/1993 Genovese ..... 361/225
5,354,540 A * 10/1994 Neumiller ..... 422/174
5,517,287 A 5/1996 Rodriguez et al. ..... 355/259
5,804,797 A * 9/1998 Kaimoto et al. ..... 219/543
6,280,691 B1 * 8/2001 Homeyer et al. ..... 422/122
2001/0025570 A1 * 10/2001 Fukushima ..... 95/57

* cited by examiner

*Primary Examiner*—Joseph Pelham
(74) *Attorney, Agent, or Firm*—Fay, Sharpe, Fagan, Minnich & McKee, LLP

(57) ABSTRACT

A method and apparatus for heating a charging unit to an appropriate temperature in a uniform manner is provided. In accordance with one example embodiment of the present invention, a heater for use in a charger includes a base. First and second contacts are disposed on the base. A heating element couples the first contact and the second contact. The heating element has an energy density that increases approximately exponentially from a first energy density at locations distal from the first and second heat sink locations to a relatively higher second energy density at locations proximal to the first and second heat sink locations. The heater, according to further embodiments of the present invention, is disposed on an opposite side of the substrate layer from the AC electrode layer, and underneath the charger.

20 Claims, 6 Drawing Sheets

HEADING ELEMENT FOR CHARGING DEVICES

FIELD OF THE INVENTION

The present invention relates to a heater suitable for use with charging devices, and more particularly to method and apparatus for improving charge uniformity and minimizing AC coupling to heater lines on chargers.

BACKGROUND OF THE INVENTION

Charged particles, or ions, can be generated in a number of different ways. Known techniques include the use of air gap breakdown, corona discharges and spark discharges. One specific method and apparatus for generating charged particles is discussed in U.S. Pat. No. 4,155,093 to Fotland et al. The method of generating ions in air as described in the '093 patent includes applying an alternating potential between a first electrode that is substantially in contact with one side of a solid dielectric member and a second electrode substantially in contact with an opposite side of the solid dielectric member. The second electrode has an edge surface disposed opposite the first electrode to define an air region at the junction of the edge surface and the solid dielectric member. This induces ion producing electrical discharges in the air region between the dielectric member and the edge surface of the electrode. An ion extraction potential is applied between the second electrode and an additional electrode member to extract ions produced by the electrical discharges in the air region.

The device and method described in the '093 patent is similar to the method and apparatus for a charging device known as a solid-state charger. The solid-state charger also extracts charges (ions and/or electrons) from a high-density plasma source. The source is created by electrical gas breakdown in a high frequency AC field between two conducting electrodes that are separated by an insulator. The potential of the electrode directly facing the photoreceptor determines the polarity and magnitude of charging current.

The solid-state charger often performs more efficiently at an elevated and uniform temperature. If the solid-state charger maintains some portions at warmer or cooler temperatures than other portions, the performance of the charger is diminished.

SUMMARY OF THE INVENTION

There is a need in the art for a method and apparatus for heating a charging unit to an appropriate temperature in a uniform manner. The present invention is directed toward further solutions to address this need.

In accordance with one example embodiment of the present invention, a heater for use in a charger includes a base. A first contact is disposed on the base and a second contact is also disposed on the base. A heating element couples the first contact and the second contact. The heating element is arranged such that an energy density of the heating element increases approximately exponentially from a first energy density at locations distal from the first and second contacts to a relatively higher second energy density at locations proximal to the first and second contacts.

The heater, according to one aspect of the present invention, mounts on a charger that is a solid-state charger.

The heating element, according to one embodiment of the present invention, is arranged on the charger in a generally elliptical pattern. Alternatively, the heater according to a second embodiment is arranged in a generally zigzag pattern. It should be noted that the exact pattern or profile of the heater element can vary, and is generally non-uniform.

According to further aspects of the present invention, the base is formed of a substrate having a first end and a second end. The first contact is disposed proximal to the first end of the base and the second contact is disposed proximal to the second end of the base.

In accordance with still further aspects of the present invention, the charger to which the heater mounts includes a substrate layer. An AC electrode layer couples with the substrate layer. A dielectric layer couples with the AC electrode layer. An aperture electrode layer further couples with the dielectric layer and is electrically insulated by the dielectric layer from the AC electrode layer.

The heater, according to further embodiments of the present invention, is disposed on an opposite side of the substrate layer from the AC electrode layer of the charger.

According to still another aspect of the present invention, a method of forming a heater for a charger is provided. The method includes providing a base. A first contact and a second contact are arranged on the base. The first contact is coupled with the second contact by a heating element in a manner such that an energy density of the heating element increases from a first energy density at locations along the heating element distal from the first and second contacts to a relatively higher second energy density proximal to the first and second contacts.

In accordance with still a further aspect of the present invention, a charger is provided that includes a substrate layer. An AC electrode layer couples with the substrate layer. A dielectric layer couples with the AC electrode layer. An aperture electrode layer couples with the dielectric layer and is electrically insulated by the dielectric layer from the AC electrode layer. Further, a heater couples with the substrate layer on an opposite side of the AC electrode layer.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION

An illustrative embodiment of the present invention relates to a heater having a heating element designed by taking into consideration a proportional relationship between a uniformity of charge emitted to a charged particle receiver and a corresponding position along a charger relative to uniformity of surface temperature of the heater and the charger.

Figure 1:
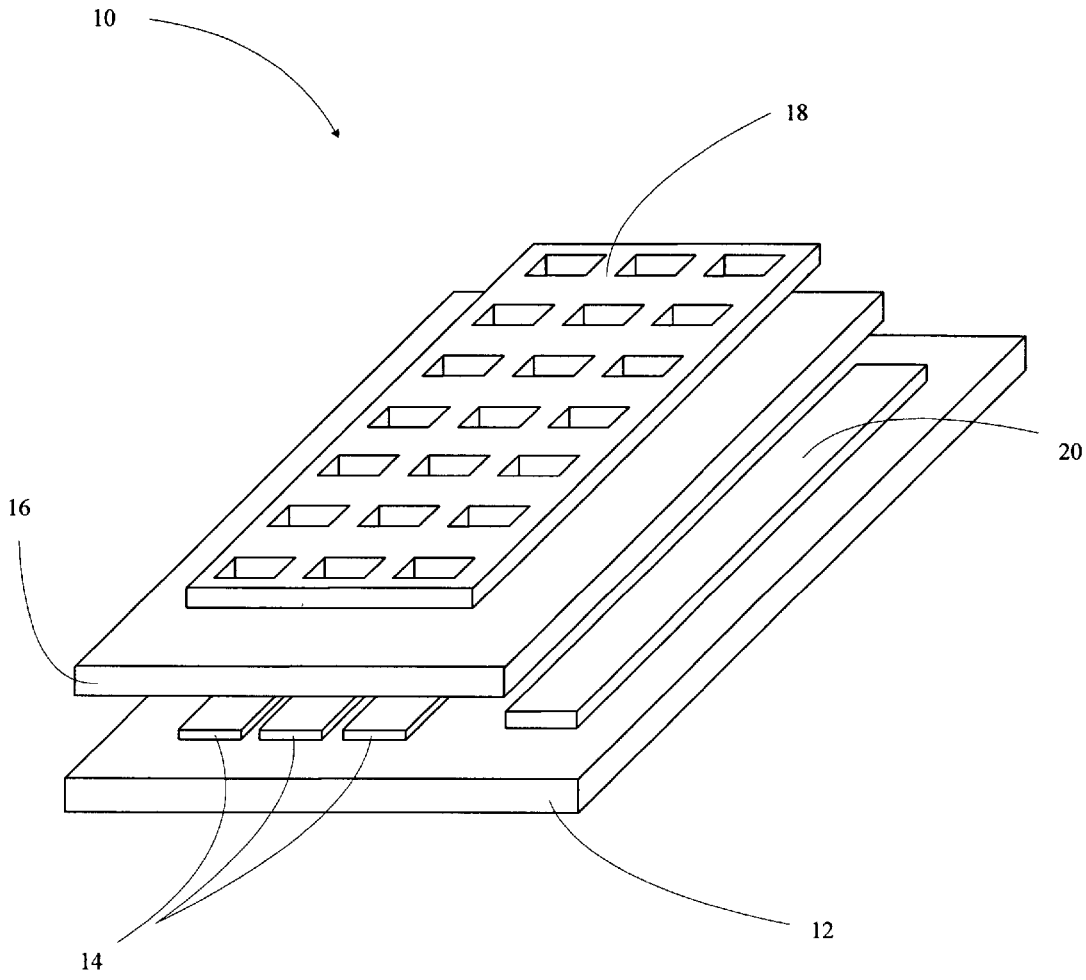
FIG. 1 Prior Art
FIG. 1 is a perspective illustration of a conventional charger.

A known structure of a solid-state charger 10 is illustrated in FIG. 1. The solid-state charger 10 can be used to emit charged particles, for example, in printing applications where charged particles are uniformly emitted from a charger 10 to a dielectric surface of a drum or receiver. The solid-state charger 10 generally includes a substrate 12, which supports a group of AC electrodes 14. A dielectric layer 16 electrically insulates the AC electrodes 14 from a layer of aperture electrodes 18. In addition, a resistive electrode heater 20 is disposed on one edge of the substrate 12 of the solid-state charger 10. The heater 20 brings the device to a desired operating temperature. In a typical case, the desired operating temperature for a solid-state charger is about 70° C. The cross-sectional area of the heater 20 is uniform across the entire electrode length.

Figure 2:
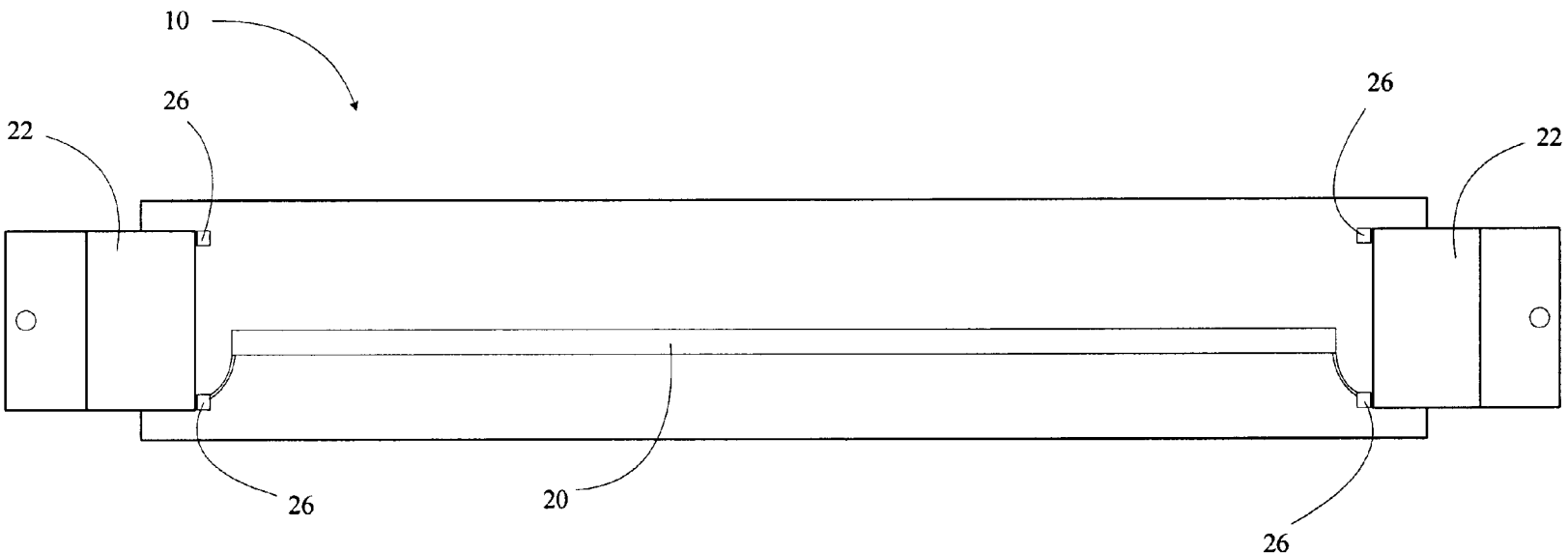
FIG. 2 Prior Art
FIG. 2 is a diagrammatic illustration of the charger of FIG. 1.

FIG. 2 illustrates a common mounting method for the solid-state charger 10. A pair of metal brackets 22 holds the solid-state charger 10 in place for a particular application. In addition, a number of electrical connectors 26 are often located on the surface of the solid-state charger 10 to power the device.

The uniform cross-section of the heater 20 would otherwise result in uniform energy dissipation in the form of heat. However, the conventional method of mounting the solid-state charger 10 with the use of metal brackets 22 and the electrical contacts 26 creates thermal energy leakage at selected points of the solid-state charger 10. The thermal energy leakage causes temperature non-uniformities for which the heater 20 is unable to compensate. These temperature non-uniformities lead to lower temperatures at the device ends, which causes uneven heating of the solid-state charger 10, thereby decreasing the operational efficiency of the charger. Specifically, the temperature non-uniformities result in charge non-uniformities, which ultimately affect the output of the solid-state charger 10.

Furthermore, the heater 20 employs a resistive line that is disposed in relatively close proximity to the AC lines of the charger. This close spacing significantly increases the chance of capacitive coupling to occur between the resistive and AC lines. This results in the heater power supply sinking some of the AC current, and also increases the load on the AC power supply without added functionality. In the past, one known solution to avoid AC coupling has been to add an AC block electrode on the surface of the charger.

FIGS. 3A through 6, wherein like parts are designated by like reference numerals throughout, illustrate example embodiments of a heater for use with a charger according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

As previously mentioned, typical charging devices such as solid-state chargers require a certain operating temperature such as, e.g., 70° C., in order to generate charge properly. Therefore, it is common practice to provide a heating element on the solid-state charger to elevate the overall temperature of the charger to the desired temperature level. A direct relationship exists between the temperature of the solid-state charger and the ability of the solid-state charger to generate charge. For example, a 16° C. temperature drop occurring within about 5 cm of either end of a solid-state charger can lead to about a 50 volt drop in voltage on a corresponding area of a charge receiver. A standard conventional heater having a uniform cross-section and pattern can not compensate for such a temperature drop.

It should be noted that the examples illustrated herein, and the following textual description, employ the term "solid-state charger" for purposes of clarity. One of ordinary skill in the art will understand that many different types of chargers and devices require heaters such as those embodied in the present invention. The heater of the present invention is therefore not intended to be limited only for use in solid-state chargers, but to any charging or similar device requiring a heating element.

There are at least two known sources for causing the temperature drop on existing solid-state chargers. The two sources illustrated herein include the use of metal brackets to mount the solid-state charger to a substrate, and the use of multiple electrical contacts to power the solid-state charger. Each element results in the creation of undesirable heat sinks that lower the temperature of the solid-state charger at each end. The lower temperature of the solid-state charger results in an undesirable and unwanted decrease in surface voltage on a particle receiver, such as a dielectric or photoconductive drum, and a corresponding increase in charge non-uniformity.

Figure 3A:
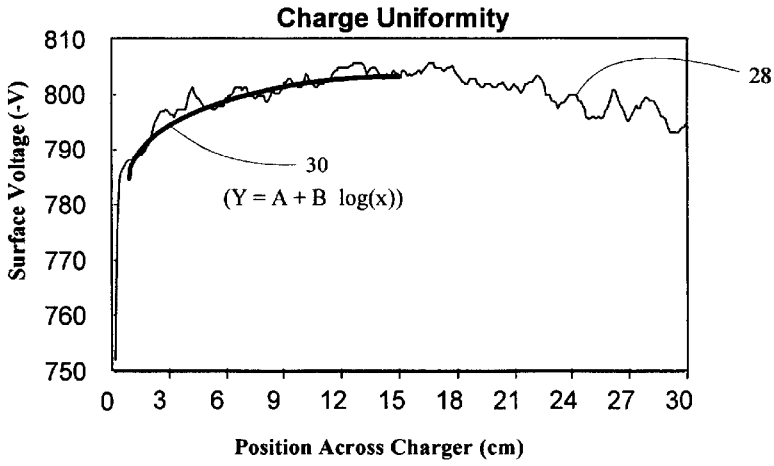
FIG. 3A is a graph of receiver surface voltage versus position across a charger surface area, according to the teachings of the present invention.

According to the teachings of the present invention, the present inventors realized that by analyzing the voltage and temperature versus position along the solid-state charger that the drop in receiver surface voltage, as well as the drop in temperature, is logarithmic in nature. FIG. 3A illustrates an example drop in receiver surface voltage. A solid-state charger was activated utilizing a known heater element of uniform cross-section disposed approximately as illustrated in FIG. 1. The heater 20 heated the solid-state charger 10, and the voltage level of the solid-state charger 10 was measured and plotted on the graph of FIG. 3A.

The graph plots receiver surface voltage along a solid-state charger versus position across the charger in centimeters. Line 28 plots actual experimental measurements. It can be seen in the graph that the actual voltage measurements at both ends of the solid-state charger were relatively lower than at intermediate positions along the solid-state charger. The voltage increased gradually as the position along the solid-state charger, away from the end supporting the mounting bracket and electrical contacts increased. Line 30 is a logarithmic curve according to the equation Y=A+B log of X, overlaid on the actual voltage measurements. The line 30 of the logarithmic curve aligns with the recorded measurements of voltage of line 28. This clearly illustrates the logarithmic nature of the voltage levels.

The graph of FIG. 3B again illustrates this relationship. Surface voltage along the surface of a receiver was plotted against the logarithmic position in centimeters along the surface of the solid-state charger. Specifically, the scale of the position in centimeters along the surface of the solid-state charger increases logarithmically. Line 32 results from a best fit of the points plotted on the graph. It is evident in the figure that the straight line 32 plotted across the logarithmic scale represents the logarithmic increase in receiver surface voltage.

As the receiver surface voltage was measured and plotted, the temperature of the solid-state charger was also measured and plotted. Correspondingly, FIG. 3C illustrates the resulting graph plotting the surface temperature of the solid-state charger in Kelvins versus the logarithmic position in centimeters along the surface of the solid-state charger. Line 34 represents an interpolation of the points plotted on this graph. It is again evident that the straight line of the graph on the logarithmic scale represents the logarithmic nature of the temperature increase along the surface of the solid-state charger as the distance increases from the cooler ends created by the heat sink nature of the brackets and contacts.

Figure 3B:
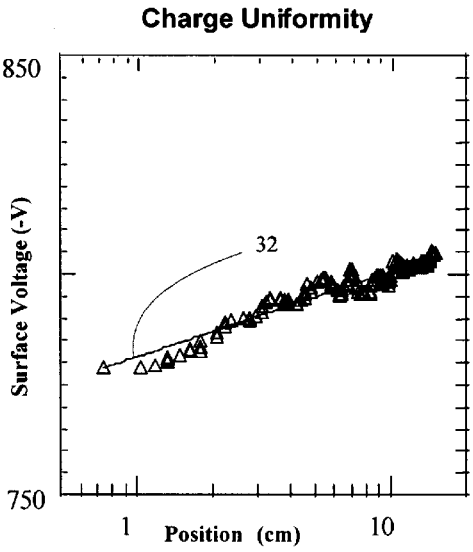
FIG. 3B is a logarithmic graph of receiver surface voltage versus position along the charger surface area, according to the teachings of the present invention.
Figure 3C:
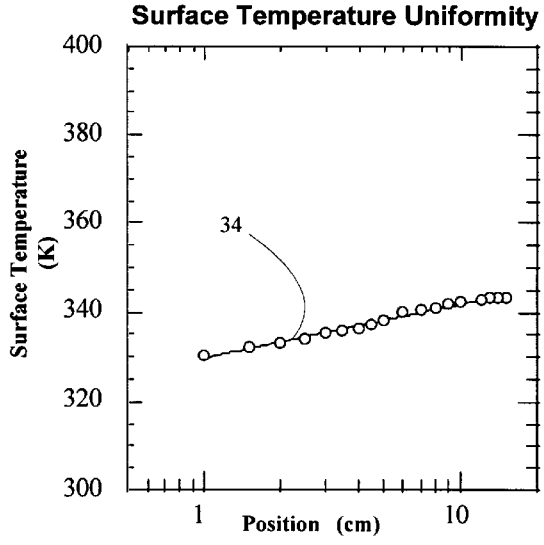
FIG. 3C is a logarithmic graph of receiver surface temperature versus position across the charger, according to the teachings of the present invention.
Figure 4:
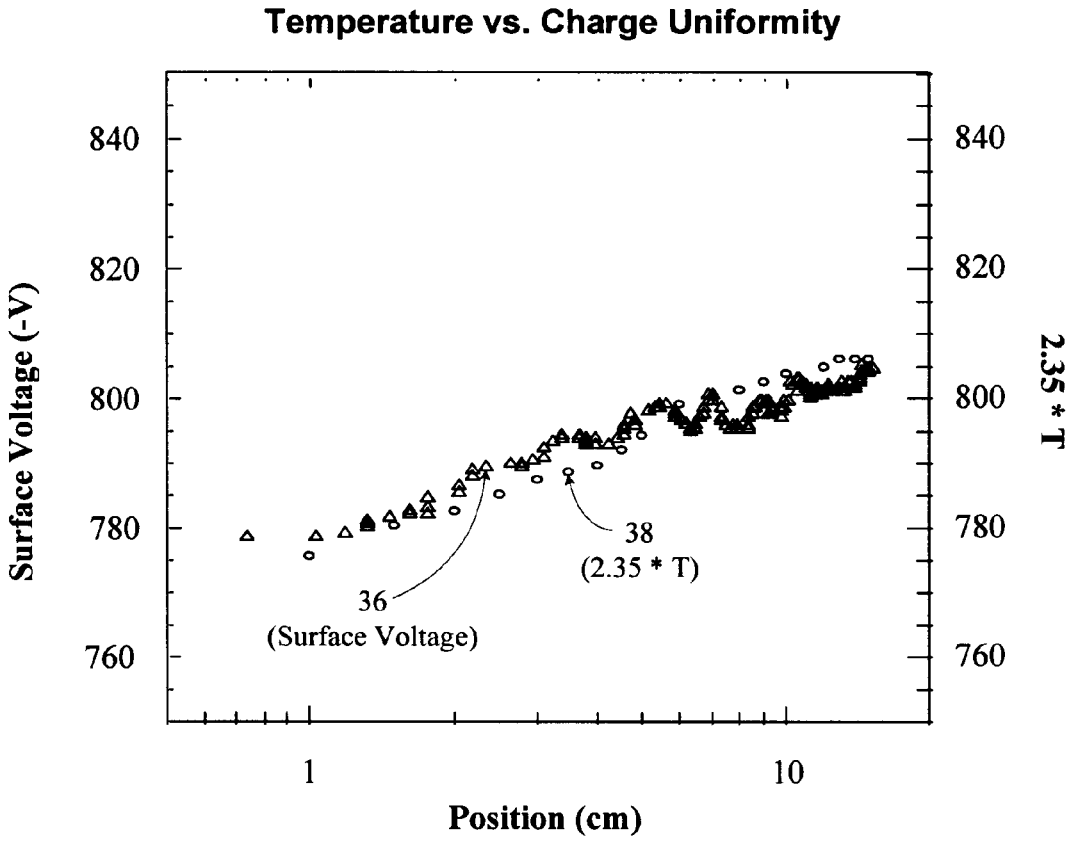
FIG. 4 is a logarithmic graph of receiver surface voltage versus position along the charger, according to the teachings of the present invention.

The graphs resulting from the logarithmic plotting of the surface voltage and the temperature, and illustrated in FIGS. 3B and 3C, can combine to form the graph illustrated in FIG. 4. The graph maintains a scale of receiver surface voltage along the ordinate axis, a scale of temperature in Kelvins along the opposed ordinate axis, and a logarithmic scale in centimeters of the position along the surface of the solid-state charger along the abscissa axis.

In this graph, the triangular data points 36 illustrating the measured surface voltage along the logarithmic position of the receiver (FIG. 3B) are in substantial alignment with the circular data points 38 resulting from the plot of the surface temperature versus the logarithmic position along the solid-state charger (FIG. 3C), multiplied by a constant factor. In order to move the line of the surface temperature data points 38 into the range of the receiver surface voltage data points 36, the measured temperature values were multiplied by a constant factor. In the case illustrated, the constant factor was 2.35. One of ordinary skill in the art will appreciate that the multiplication constant and/or the logarithmic nature of the voltage and temperature non-uniformities may change depending on the particular solid-state charger geometric factors. For this particular case, the embodiment consisted of a three-coronode device with rectangular aperture geometry. However, the mathematical logarithmic nature of the voltage and/or surface temperature of the solid-state charger relative to the physical location along the surface of the charger remains.

Figure 5A:
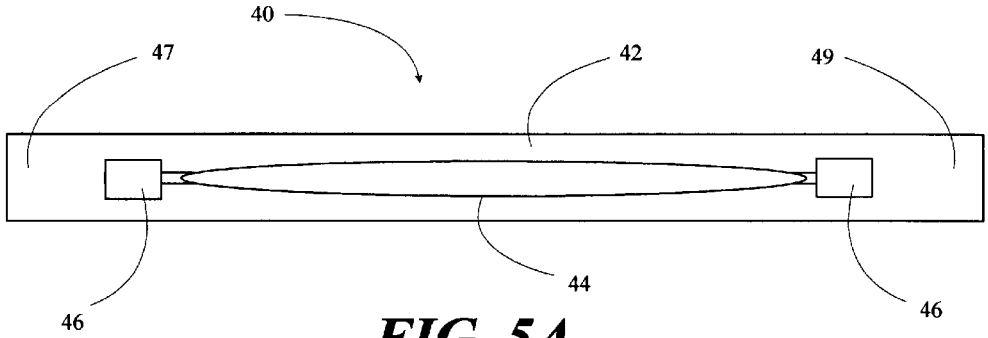
FIG. 5A is a diagrammatic illustration of one embodiment of a heater, according to the teachings of the present invention.

The mathematical relationship between the temperature and the charge uniformity along the surface of a solid-state charger can be used in designing a solid-state charger heater element, according to the teachings of the present invention. FIG. 5A illustrates one such heater 40. The heater 40 includes a substrate 42 that mounts a heating element 44. A pair of electrical contact pads 46 is also mounted on the substrate 42. Each of the contact pads 46 are disposed at distal ends 47 and 49 of the substrate 42. The ends 47 and 49 of the substrate 42 correspond to the ends of a solid-state charger when the heater 40 is installed on a charger.

The illustrated heating element 40 has a pattern, shape, or profile, of approximately an elliptical shape, wherein the energy density proximal to each of the contact pads 46 of the heating element 44 increases to compensate for the loss of heat (thermal leakage) found at the ends 47 and 49 of the substrate 42. More specifically, the heat generated by the ends of the heating element 44 closer to the ends 47 and 49 of the substrate 42 where heat is lost is greater than in locations closer to the middle of the substrate 42. To further clarify, the heater is resistive in nature. The resistance (which is inversely proportional to the cross sectional area of the conductor, in this case the heating element) increases towards the ends 47 and 49 of the substrate 42 as the cross sectional area diminishes (in a logarithmic fashion), thus dissipating more energy in the form of heat. The rate of temperature increase as one moves along the surface of the substrate 42 is logarithmic.

Figure 5B:
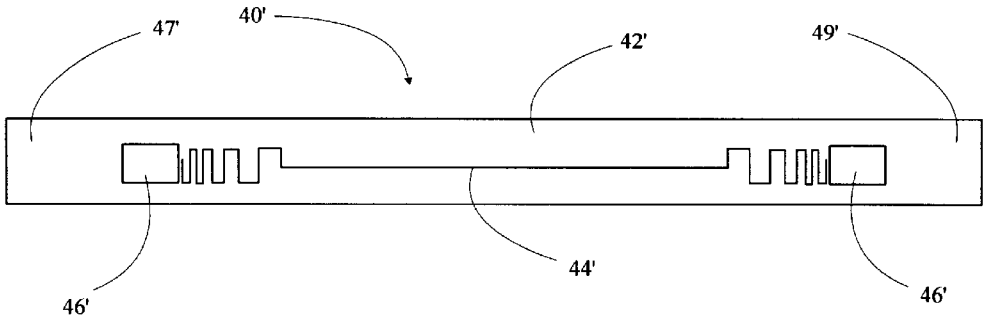
FIG. 5B is a diagrammatic illustration of another embodiment of a heater, according to the teachings of the present invention.

FIG. 5B illustrates a second possible embodiment for arrangement of a heating element 44'. A heater 40' is provided having a substrate 42' with a first end 47' and a second end 49'. Two contact pads 46' mount on the substrate 42' at the distal ends 47' and 49'. The heating element 44' extends between each of the contact pads 46' in approximately a zigzag pattern. It can be seen from this figure, that the zigzag pattern provides for an increased energy density towards the ends 47' and 49' of the substrate 42'. Again, this compensates for thermal leakage at the ends 47' and 49' and results in overall thermal uniformity of the heater 40'. The increase in energy density traveling along the surface of the substrate 42' is again, exponential, based on the logarithmic temperature reduction caused by the heat sink contact pads 46'.

One of ordinary skill in the art will appreciate that the location of the heat sinks on the solid-state charger can vary depending on the particular installation arrangement. Therefore, the location of the higher energy density areas along the heating element can also vary. Wherever there are heat sinks on the solid-state charger, there is a logarithmic decrease in voltage output, which in turn requires an exponential increase in energy density (heat) from the heater to compensate for the heat loss and correct the voltage level to be uniform across the entire solid-state charger. The locations of the heat sinks may be non-uniform in nature across the solid-state charger. The requirements for increases in energy density can likewise be predicted and implemented in a non-uniform manner utilizing the teachings of the present invention.

Figure 5C:
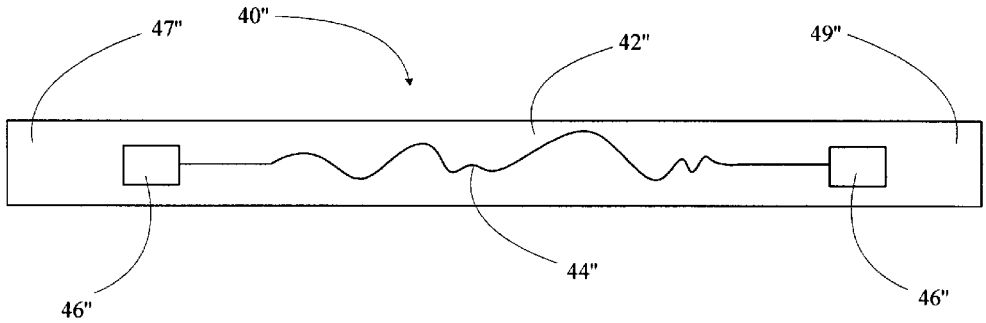

For example, the heating element can be of non-uniform shape and/or cross-section as illustrated in FIG. 5C. The term "non-uniform" as used herein is intended to include any suitable shape, pattern, profile, or cross-section that varies in at least one dimension. Those of ordinary skill in the art will recognize that the specific shape utilized is directly related to the location and size of the heat sinks.

In FIG. 5C, a heating element 44" is illustrated. A heater 40" is provided having a substrate 42" with a first end 47" and a second end 49". Two contact pads 46" mount on the substrate 42" at the distal ends 47" and 49". The heating element 44" extends between each of the contact pads 46" in a non-uniform manner. It can be seen from this figure, that the non-uniform pattern creates increased energy density in various locations between the ends 47" and 49" of the substrate 42". This compensates for thermal leakage at non-uniform locations along and around the heating element 44", based on any number of external factors that may cause such a heat sink (i.e., fasteners, surfaces exposed to increased cooling, and the like), and results in overall thermal uniformity of the heater 40".

The location of the heater 40, 40', 40" on a solid-state charger 50 can affect the heat distribution and resulting heat uniformity of the solid-state charger. Non-uniform heating of the solid-state charger results in non-uniform charge generation.

Figure 6:
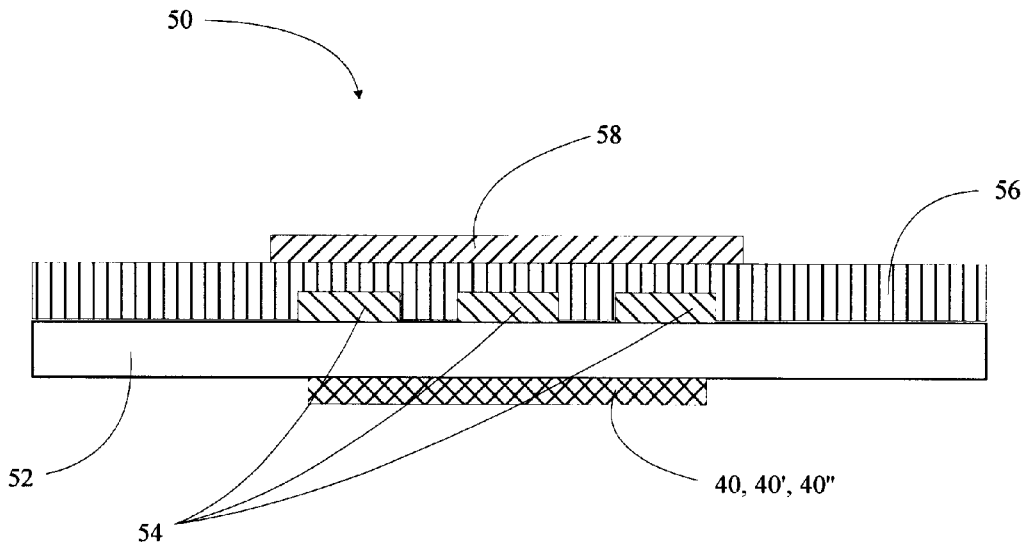
FIG. 6 is a cross-sectional illustration of a charger according the teachings of the present invention.

The heater 40, 40', 40" mounts to a typical solid-state charger 50 as illustrated in FIG. 6. The solid-state charger 50 includes a substrate 52 upon which a layer of AC electrodes 54 mounts. A dielectric 56 encompasses the AC electrodes 54 and electrically insulates the AC electrodes 54 from a layer of aperture electrodes 58. The heater 40, 40' couples with the substrate 52 of the solid-state charger 50 on a side of the substrate 52 opposite the AC electrodes 54. The positioning of the heater 40, 40', 40" on a side of the substrate 52 opposite the AC electrode greatly reduces AC coupling from occurring. Therefore, there is a greatly reduced risk of loss of power or problems with the heater power supply.

The use of a single heater electrode disposes of the need for AC block lines. Capacitive coupling can be reduced as much as 80% from previous known structures. The removal of AC block lines provides additional space on the charger surface for other uses such as additional coronodes for redundancy.

The heater 40, 40', 40" of the present invention can bring a solid-state charger 50 to its operating temperature in a uniform manner. The heater consists of an electrically resistive line or heating element 44 that is patterned, or profiled, taking into consideration a logarithmic relationship between receiver surface voltage and thermal levels versus position along a surface of the solid-state charger 50. The new pattern results in the heating element 44 having an increased energy density toward the ends of the solid-state charger 50, following an exponential relationship, when the heat sink is located at the ends of the solid-state charger. If the heat sink occurs in other locations along the solid-state charger 50, exponential increases in energy density can be calculated and applied accordingly. This results in a more uniform heater 40, 40', 40", as well as a more uniform heating of the solid-state charger 50, and subsequently a more uniform charge emission from the solid-state charger 50.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

What is claimed is:

1. A heater for use in a charger, said heater comprising:

a base;

a first contact disposed on said base;

a second contact disposed on said base; and a heating element coupled to said first contact and said second contact, said heating element arranged such that an energy density of said heating element increases approximately exponentially from a first energy density at one or more predetermined non-heat sink locations to a relatively higher second energy density at one or more predetermined heat sink locations.

2. The heater according to claim 1, wherein said predetermined non-heat sink locations correspond with locations in said charger having no heat sinks and said predetermined heat sink locations correspond with locations in said charger having heat sinks.

3. The heater according to claim 1, wherein said heating element is arranged in a generally elliptical pattern.

4. The heater according to claim 1, wherein said heating element is arranged in a generally zigzag pattern.

5. The heater according to claim 1, wherein said heating element is arranged in a non-uniform pattern.

6. The heater according to claim 1, wherein said base comprises a substrate.

7. The heater according to claim 1, wherein said base comprises a first end and a second end.

8. The heater according to claim 7, wherein said first contact is disposed proximal to said first end and said second contact is disposed proximal to said second end.

9. The heater according to claim 1, wherein said charger further comprises:

a substrate layer;

an AC electrode layer coupled with said substrate layer;

a dielectric layer coupled with said AC electrode layer; and an aperture electrode layer coupled with said dielectric layer and electrically insulated by said dielectric layer from said AC electrode layer.

10. The heater according to claim 9, wherein said heater is disposed on an opposite side of said substrate layer from said AC electrode layer.

11. The heater according to claim 1, wherein said charger is a solid-state charger.

12. A charger, comprising:

a substrate layer;

an AC electrode layer coupled with said substrate layer;

a dielectric layer coupled with said AC electrode layer;

an aperture electrode layer coupled with said dielectric layer and electrically insulated by said dielectric layer from said AC electrode layer; and a heater coupled with said substrate layer on an opposite side from said AC electrode layer.

13. The charger according to claim 12, wherein said heater comprises:

a base;

a first contact disposed on said base;

a second contact disposed on said base; and a heating element coupling said first contact and said second contact.

14. The charger according to claim 13, wherein said heating element is arranged such that an energy density of said heating element increases approximately exponentially from a first energy density at locations distal from heat sink locations to a relatively higher second energy density at locations proximal to heat sink locations.

15. A heater for use in a charger, said heater comprising:

a base;

a first contact disposed on said base;

a second contact disposed on said base; and a heating element coupling said first contact and said second contact, said heating element arranged in a non-uniform pattern such that an energy density of said heating element increases approximately exponentially from a first energy density at predetermined non-heat sink locations to a relatively higher second energy density at predetermined heat sink locations.

16. The heater according to claim 15, wherein said base comprises a substrate.

17. The heater according to claim 15, wherein said charger further comprises:

a substrate layer;

an AC electrode layer coupled with said substrate layer;

a dielectric layer coupled with said AC electrode layer; and an aperture electrode layer coupled with said dielectric layer and electrically insulated by said dielectric layer from said AC electrode layer.

18. The heater according to claim 17, wherein said heater is disposed on an opposite side of said substrate layer from said AC electrode layer.

19. The heater according to claim 15, wherein said charger is a solid-state charger.

20. The heater according to claim 15, wherein said heater maintains a non-uniform cross-section.

* * * * *